US005735964A

United States Patent [19]

Amuny

[11] Patent Number: 5,735,964

[45] Date of Patent: Apr. 7, 1998

[54] METHOD FOR CLEANING TUBE BUNDLES

[76] Inventor: Jim E. Amuny, 506 Brimstone, Sulphur, La. 70663

[21] Appl. No.: 494,162

[22] Filed: Jun. 23, 1995

Related U.S. Application Data

[62] Division of Ser. No. 101,464, Aug. 2, 1993, Pat. No. 5,451,002.

[51] Int. Cl.[6] ..... B08B 3/02

[52] U.S. Cl. ..... 134/8; 134/22.11; 134/23; 134/22.12

[58] Field of Search ..... 134/8, 22.11, 22.12, 134/23, 24, 25.1

[56] References Cited

U.S. PATENT DOCUMENTS

| | | | |
|---|---|---|---|
| 3,901,252 | 8/1975 | Riebe | 134/167 C |
| 4,095,305 | 6/1978 | Goodwin | 134/167 C |
| 4,214,704 | 7/1980 | Nagai | 239/753 |
| 4,220,282 | 9/1980 | Behr | 239/753 |
| 4,805,653 | 2/1989 | Krajicek et al. | 134/172 |
| 4,865,545 | 9/1989 | Krajicek et al. . | |
| 5,002,120 | 3/1991 | Boisture et al. | 122/391 |
| 5,022,463 | 6/1991 | Boisture | 15/317 |
| 5,031,691 | 7/1991 | Boisture | 134/167 C |
| 5,067,558 | 11/1991 | Boisture | 15/317 |
| 5,129,455 | 7/1992 | Boisture | 15/317 |
| 5,184,636 | 2/1993 | Van Der Woude | 134/167 C |
| 5,261,600 | 11/1993 | Cradeur | 134/172 |

FOREIGN PATENT DOCUMENTS

| | | |
|---|---|---|
| 542370 | 6/1957 | Canada . |
| 3626997 | 2/1988 | Germany . |

*Primary Examiner*—Lyle A. Alexander
*Attorney, Agent, or Firm*—Browning Bushman

[57] ABSTRACT

An assembly for cleaning a tube bundle including a plurality of elongated tubular lances movable within an outer shell. A flexible fluid hose within the shell extends to the manifold in the lower portion of the assembly, which in turn transmits pressurized fluid to the plurality of lances. The hydraulic motor powers a rack and pinion assembly to reciprocate the lances, while a plurality of spring biased plates each cover a slot in the lance housing. The assembly of the present invention utilizes a receiving manifold and a lance manifold connected by a plurality of nipples for a desirable low pressure drop. A pair of series connected valves allows the hydraulic fluid flow and the pressure to the drive motor to be separated controlled.

16 Claims, 2 Drawing Sheets

METHOD FOR CLEANING TUBE BUNDLES

This is a divisional of application Ser. No. 08/101,464, filed on Aug. 2, 1993, now U.S. Pat. No. 5,451,002.

FIELD OF THE INVENTION

The present invention relates to equipment and techniques for cleaning tube bundles, and more particularly relates to improvement in multi-lance equipment for cleaning industrial tube bundles.

BACKGROUND OF THE INVENTION

Powered lance assemblies have been used for decades to clean the tubes of heat exchanger bundle assemblies. Those familiar with industrial heat exchange equipment and chemical processing techniques recognize that a variety of tube bundle assemblies are mounted at various elevations and orientations in industrial and chemical plants, and that the elongate tubes in these heat exchanger bundles must be periodically cleaned to maintain proper processing efficiency. While such tube bundles have been cleaned for years with powered equipment, i.e., equipment using a powered force to drive the lance through a tube, it is not uncommon today for bundles to be cleaned manually, or to be cleaned with outdated equipment. In many instances, more complex and expensive cleaning equipment cannot be practically positioned for cleaning the tube bundle in place, and the tube bundle cannot be removed from the plant, cleaned, then reinstalled in a cost-effective manner. To clean industrial tube bundles on a cost-effective basis, the lance assembly ideally has a powered drive to pass the lance through the tube bundle, and the assembly uses a plurality of lance tubes, so that the equipment may be used for simultaneously cleaning multiple tubes of the tube bundle to reduce the overall time for cleaning the tube bundle.

Various techniques and concepts of thus been devised for cleaning tube bundles. U.S. Pat. No. 4,095,305 discloses tube bundle cleaning equipment including a frame for mounting a lance, track members, and a carriage. U.S. Pat. No. 4,085,653 discloses cleaning equipment which is essentially mounted on the end of a mobile machine, such as a truck. U.S. Pat. Nos. 5,002,120, 5,022,463, 5,067,558, and 5,129,455 are each directed to lance tube cleaning equipment having a spool assembly used to store a flexible water line, a lance assembly supplied with water from the spool assembly, and a positioned assembly for supporting the spool assembly and lance assembly so that the lance assembly can be raised to its proper elevation relative to the tube bundle to be cleaned. U.S. Pat. No. 4,856,545 discloses a multi-lance tube bundle cleaner which utilizes a linked drag chain for transporting water from the lower end of the lance housing to the powered lances in the upper end of the housing. U.S. Pat. No. 5,031,691 discloses a similar lance assembly which may be used to clean either horizontal or vertical tube bundle assemblies. A slidable plate is used to cover the elongate opening in the lance housing during reciprocal movement of the lances.

Prior art lance assemblies for cleaning tube bundles have a number of problems which have limited their efficiency and thus their utility. As discussed briefly above, one of the major problems concerns the size of lance assembly equipment itself, which in many cases is so massive that the equipment cannot be easily positioned for cleaning the tube bundle while the tube bundle remains in place in the plant, particularly in areas where access is restricted. Many prior art lance a location exterior of the plant, then returned for installation in the plant. Even when the tube bundle is removed for cleaning, many prior art lance assemblies require that the tube bundle be elevated and blocked, or that the bundle remain raised off the floor by a crane, so that the lance assembly can practically clean the tube bundle. The pumping unit which supplies pressure to the lances is often mounted with the lance assembly, and these prior art lance assemblies effectively require that the lance assembly and the pumping unit each be positioned with respect to the tube bundle to be lanced, thereby again increasing the size and limiting the versatility of the lance assembly.

Another significant problem concerning prior art lance assemblies has to do with the significant pressure drop which undesirably occurs between the pumping unit and the discharge end of the lances, particularly when pumping pressure is high. Some prior art lance assemblies utilize a plurality of small diameter hoses extending to the lance manifold, which results in a significant pressure drop. Other lance assemblies coil the hoses supplying fluid to the lances in a reel assembly, thereby minimizing the pressure which can practically be supplied to the lances. In some prior art lance assemblies, the manifold distributing fluid to the plurality of lances is located a substantial distance upstream from the lances rather than being positioned adjacent the lances, and accordingly the pressure drop through the system is relatively high. This pressure drop significantly detracts from the efficiency of the lancing assembly to perform its cleaning function, and in many applications this pressure loss substantially increases the time for an operating crew to properly clean the tube bundle. Other prior lance assemblies provide for operator control of the lance speed relative to the tube bundle, but it is difficult to achieve the desired combination of speed and force to move the multi-lances through the tube bundle to perform their cleaning operation. As a consequence, the risk is high that a lance may become jammed and ruin one of the tubes within the bundle being cleaned, thus significantly increasing the overall repair costs.

Some lance assemblies are designed to be picked up vertically, e.g., by a crane, for positioning with respect to an elevated tube bundle for performing a horizontal lancing operation. In many cases, however, the lance assembly itself is so massive and heavy, and/or the crane hook-up attachment is so attached to the lance housing, that the task of positioning the lance assembly with respect to the tube bundle is both difficult and time consuming. Other prior art lancing assemblies which are elevated for use to clean a tube bundle effectively require that scaffolding be provided, so that the cleaning crew can effectively perform their cleaning operation. The cost of the scaffolding and erection time thus must be considered in determining the overall cost of the tube bundle cleaning operation.

The disadvantages of prior art are overcome by the present invention, and an improved tube bundle cleaning assembly and technique for cleaning bundles is hereinafter disclosed which, in a safe and reliable manner, will effectively reduce the cost associated with cleaning a tube bundle.

SUMMARY OF THE INVENTION

In a suitable embodiment, the powered multi-lance assembly of the present invention has an overall compact design and reduced weight which substantially enhances the ease which the assembly can be positioned with respect to the bundle to be cleaned. The tube bundle may be of the type used for heat exchange, and includes a relatively large number of elongate tubes having a finned exterior and an interior cylindrical flow path. The lance assembly comprises an outer body or shell which houses a manifold block extending to the lances and a powered drive mechanism, including a drive motor and a rack and pinion assembly, for reciprocating the manifold block and the plurality of lances. A power source for powering the drive motor and reciprocating the lances is physically separate from the lance assembly. The power source is connected to the drive motor by flexible hoses, thereby contributing to the compact and lightweight design of the lancing assembly. The plurality of elongate lances are housed within a lance housing. When positioned for horizontal cleaning of a tube bundle, the manifold block and thus the plurality of lances desirably exit the lowermost portion of the lance assembly, so that assembly can be used to clean a tube bundle positioned only a few centimeters above the ground. A single attachment for vertical pickup of the lance assembly is positioned on the lance housing so that the lance assembly is substantially balanced when the lances are retracted within the lance assembly outer shell, thereby enabling the cleaning crew to easily position the lance assembly with respect to the tube bundle. In many instances, the cleaning crew can operate the lance assembly of the present invention when the assembly is suspended from a crane, with the cleaning crew being reliably supported on an adjacent catwalk for viewing the cleaning operation and controlling the operation of the lance assembly.

The assembly of the present invention provides a comparatively low pressure drop between the water pump and the discharge end of the lances. The manifold assembly includes an receiver manifold and a lance manifold fluidly connected in series with a plurality of small diameter nipples. A relatively small amount of pressure is lost between the water pumping unit and the tip end of the lances, since a single, relatively large diameter flexible hose is used within the assembly for allowing reciprocal movement of the lances and manifold assembly, and this single hose extends at least substantially to the manifold assembly. The technique for supplying water to the manifold assembly is relatively simple and thus reliable, and does not detract from the desire for a multi-lance assembly to have a reduced size and weight. A plurality of spring biased plates are each positioned along the length of the elongate slot in the lance housing. Bumpers positioned laterally at opposing ends of the series of connecting nipples engage the deflectors to allow movement of the lances while covering the slot to effectively keep the lances positioned within the lance housing.

The drive mechanism for reciprocating the lances and the manifold block, which may include a rack and pinion assembly, is powered by a hydraulic unit positioned separate from lance assembly. The controls for powering the hydraulic drive motor according to the present invention effectively allow for both the speed and the force of the driving power to the lances to be controlled independently, thereby facilitating reliable adjustment of the lancing operation while minimizing damage to both the lance assembly and to the tube bundle during the cleaning operation.

It is an object of the present invention to provide an improved lance assembly for reliably cleaning tube bundles, with the assembly having a compact and lightweight design to enhance its utility.

It is a further object of this invention that a lance assembly allow for horizontal cleaning of various types of tube bundles without substantially elevating the tube bundle from the ground.

It is another object of the present invention to provide a lance assembly which has a comparatively low pressure drop across the lance assembly, thereby being capable providing a higher pressure to perform the lance cleaning operation.

A feature of the invention is that the lance assembly may be easily and reliably positioned by a crane for cleaning an elevated tube bundle utilizing a pivot balanced design as disclosed in the specification.

Another feature of the invention that the drive means for reciprocating the lances, which may include a rack and pinion assembly, may be easily and reliably controlled to separately regulate the speed and the force imposed on the lances when moving through the tube bundle.

It is yet another feature of the invention that the elongate slot in the lance housing is easily and reliably covered by a plurality of spring biased plate assemblies, each of which is deflected out of position for normally covering the slot in the lance housing to allow the manifold block to pass by.

An advantage of the present invention is that the assembly may be easily and inexpensively manufactured from corrosion resistant materials, such as stainless steel, so that the cleaning equipment has a long life and thus a low overall cost.

Another advantage of the present invention is that the lances may be easily and reliably contained within the lance housing by providing a plurality of movable spring biased plates which normally cover the elongate slot in the lance housing.

An advantage of the invention is that the lance assembly controls may be easily utilized in various applications by cleaning operators to control the lance assembly while the operators are supported separate from the lance assembly.

These and further objects, features, and advantages of the present invention will become apparent from the following detailed description, wherein reference is made to the figures in the accompanying drawings.

DETAILED DESCRIPTION OF PREFERRED EMBODIMENTS

Figure 1:
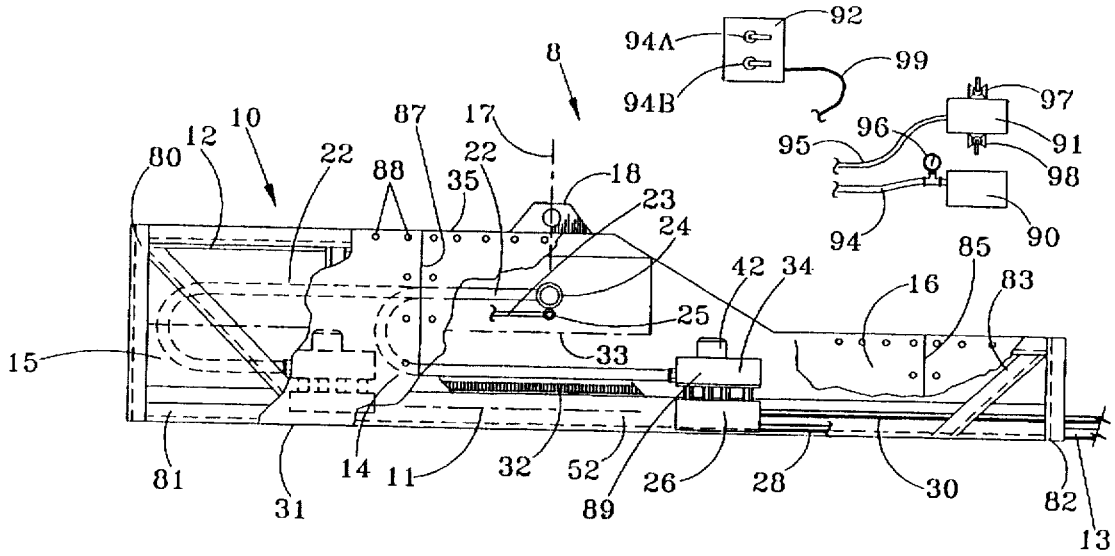
FIG. 1 is a side view, partially in cut away, of a suitable embodiment of a tube bundle cleaning assembly according to the present invention.

FIG. 1 simplistically depicts a tube bundle cleaning assembly 8 according to the present invention, comprising a powered lance assembly 10, an operator control panel 92, a high pressure water pumping unit 90, and a hydraulic pumping unit 91. Those skilled in the art will appreciate that the tube bundle cleaning assembly shown in FIG. 1 may be used to clean a variety of tube bundles commonly used in industrial and chemical plants. In a suitable application, the tube bundle may be used for a heat exchange operation, and the efficiency of the heat transfer depends in part upon the cleanliness of the elongate tubes within the tube bundle. After a period of extended use, the interior of the tubes may become corroded or caked with a variety of minerals or other deposits, and cleaning of the elongate tubes within the bundle enhances the efficiency of the heat transfer operation.

The powered lance assembly 10 comprises a conventional metal frame 12 which includes a plurality of angle iron or other structural members 80, 81, 82, and 83, and a sheet metal housing or shell 14. To prolong the useful life of the assembly 10, the frame 12 and/or the sheet metal housing 14 may be fabricated from a corrosion resistant material, such as stainless steel. The ends of sheet metal panels may be butted together as shown by seams 85, 87, and each of the sheet metal panels may be removably secured to the frame 12 by conventional securing means, such as bolts 88. By removing one or more of the sheet metal panels, the interior components may be easily inspected and repaired as necessary. FIG. 1 is a side view of the assembly 10, which in a vertical plane has a generally rectilinear cross-sectional configuration. The assembly 10 may be fabricated in various sizes, with a representative assembly 10 having a length of approximately 7 meters (26.5 feet). The rearward end 15, which has cross-sectional dimensions of approximately 20 centimeters (8 inches) in width and approximately 43 centimeters (17 inches) in height, receives pressurized water and transmits the water to lances for conducting the cleaning operation. Shell 14 has a centerline 33 spaced midway between the top surface 35 and the bottom surface 31 of the assembly 10, and separates the housing into upper and lower portions discussed subsequently. The front end 16 of the assembly 10 has the same width but a shorter height of approximately 28 centimeters (11 inches), and is the discharge or exit end for the lances.

The powered lance assembly 10 may be elevated by a crane or similar apparatus via connection plate 18 in order that the lance assembly may be elevated for horizontally cleaning a tube bundle. The lance assembly 10 may also be raised and positioned so that the lance assembly may be used to clean a tube bundle having vertical tubes. If desired, a pair of guide pipes 13 may be removably secured to and extend outwardly from the front end of the frame 12 to facilitate proper alignment of the lance assembly 10 with the tube bundle to perform the cleaning operation. The powered lance assembly 10 as shown in FIG. 1 is relatively compact and lightweight, e.g., less than 550 kilograms (about 1200 pounds), thereby contributing to the ease which the lance assembly can be manipulated for cleaning a tube bundle. To facilitate this goal, the pumping unit 90 which supplies high pressure fluid to the lance assembly 10 is physically positioned separate from the lance assembly, so that the heavy pumping unit need not be elevated with the lance assembly for a cleaning operation. FIG. 1 thus simplistically depicts a pumping unit 90 separate from the lance assembly 10, and those skilled in the art will appreciate that the pumping unit 90 may be suitably positioned on a skid or other transportable structure separate from the lance assembly.

Pressurized water or other fluid discharged from the pumping unit 90 may be passed to operator control box 92, which preferably is also positioned separate from the lance assembly, and is then transmitted to the lance assembly 10 through a flexible water pressure line 94. One or more gauges 96 may be provided at unit 90 or along line 94 for providing a fluid pressure reading output from the pumping unit 90. Another pumping unit 91 transmits hydraulic power to the assembly 10, and may also be skid mounted separate from the assembly 10. Hydraulic pumping unit 91 transmits pressurized hydraulic fluid to the lance assembly 10 through flexible hose 95. A pair of control valves fluidly connected in series control hydraulic fluid flow and pressure to the lance assembly 10. Control valve 97 is of the type adapted for regulating the flow rate (e.g., in gpm) to the lance assembly 10, and thereby controls the speed of the hydraulic motor in the lance assembly discussed subsequently. A separate control valve 98 is adapted for controlling the pressure of hydraulic fluid to the driving motor of the lance assembly 10, and thus controls the force exerted on the lances while moving with respect to the tube bundle, as described subsequently. Suitable valves 97 and 98 may be incorporated into the pumping unit 91, which may be a pressure compensated vane pump marketed under Model Number PVR6-6B15-BF-0-6-H and is commercially sold by Continental Hydraulics in Savage, Minn.

Those skilled in the art will appreciate that another pumping unit may be utilized, and that suitable valves 97 and 98 may be provided in the flow line 95 from the pumping unit 91 to inlet 25. By selectively controlling valves 97 and 98, the operators of the lance assembly may pass the lances fairly rapidly through tubes which have few deposits. During this operation, the valve 98 may be adjusted so that there is a low driving force on the lances, since no significant obstructions are anticipated. If one or more of the lances encounter substantial resistance, the low driving force is insufficient to continue relative movement of the lances within the tubes, but desirably neither the lances nor the bundle tubes are damaged. When cleaning tubes substantially filled with deposits, such as thick hydrocarbon sludge, the velocity of the lances traveling through the tube bundle may be slowed by adjusting valve 97, and the driving force or power on the lances slowly increased by adjusting valve 98, until the sludge is pushed by the lances out the opposing open end of the tube bundle in a manner similar to grease being slowly released from a gun. If desired, the flexible hoses 94 and 95 may be intermittently connected by a strap or other suitable member, so that together the pair of hoses extend to the lance assembly 10.

FIG. 1 depicts a fluid inlet 24 in the side of the assembly 10 for receiving water from line 94, and an adjacent hydraulic line inlet 25 for receiving pressurized fluid from hose 95. It is a particular feature of the present invention that the assembly 10 include a plurality of elongate lances, represented by upper lances 30 and lower lances 28, which exit the lower portion of the lance assembly, and ideally exit the lance assembly less than about 10 centimeters above the ground engaging surface 31 of the assembly 10. Accordingly, both the water inlet and the hydraulic power inlet are provided in the upper portion of the lance assembly 10, i.e., the portion between top surface 35 and centerline 33. Fluid is thus transmitted through the respective flexible lines 22 and 23 to supply pressurized fluid to the lances, and to supply hydraulic power to the drive motor 42, respectively, each provided in the lower portion of the lance assembly, i.e., between centerline 33 and lower surface 31.

FIG. 1 depicts in dashed lines the approximate position of the motor 42 and manifolds 34 and 26 when the lances are fully retracted, and illustrates in solid lines the position of these same components when the lances are extended partially from the frame 12 for insertion into the tube bundle. The positions of the flexible lines 22 and 23 interconnecting the inlets 24 and 25 with the manifold 34 and the motor 42 thus illustrate how these fluid connections may be made while still allowing for reciprocation of the lances with respect to the assembly frame 12. A portion of the elongate rack or drive gear 32 for the rack and pinion mechanism which cooperates with the motor 42 is also shown in FIG. 1.

Figure 2:
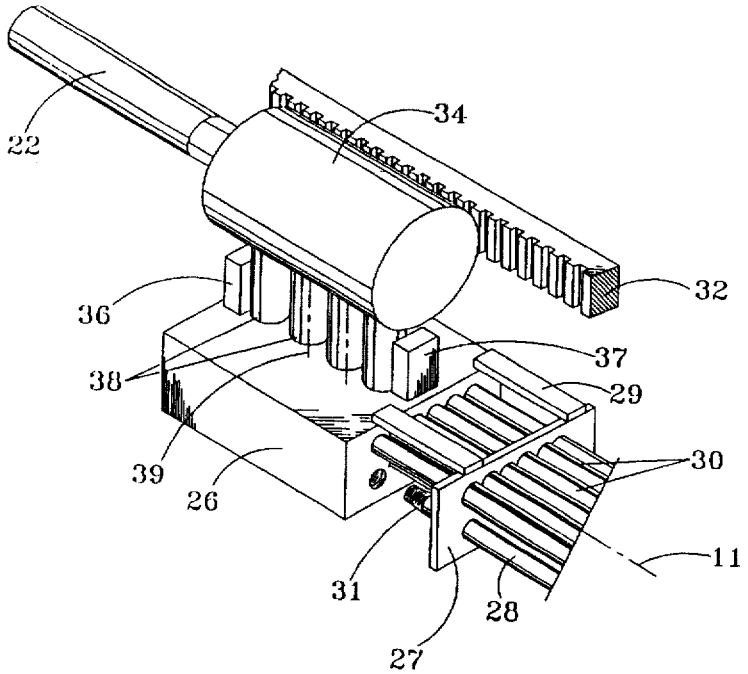
FIG. 2 is a pictorial view of a portion of the tube bundle cleaning assembly generally shown in FIG. 1, including particularly the manifold and the rearward ends of a plurality of lances.

FIG. 2 illustrates the flexible hose 22 feeding high pressure fluid to the receiving manifold 34, which may have a generally sleeve-shaped configuration. A plurality of small diameter nipples, such as the four nipples 38 as shown in FIG. 2, fluidly interconnect the receiving manifold 34 with the lance manifold 26. The lance manifold 26 has a generally rectilinear configuration, and the front face of the manifold 26 is provided with threaded ports each for receiving a respective lance. Each of the lances 28 and 30 thus has a threaded receiving end 31, which allows each lance to be easily connected to and removed from the manifold 26. If desired, a threaded reducer may be used to interconnect a lance with a threaded port in manifold 26 having a different diameter. To reduce stress and thus minimize the likelihood of failure between the lance threads and the manifold, a support plate 27 having a plurality of ports each sized for tightly receiving a respective lance may be positioned slightly in front of the manifold 26, and may be fixed to the manifold by one or more brackets 29 each bolted or welded in place. The assembly as shown in FIG. 2 includes six upper lances 30 and six lower lances 28, although the spacing and number of lances may be altered depending on the size and the orientation of the tubes within the tube bundle to be cleaned. FIG. 2 also depicts a front bumper member 37 and a rear bumper member 36 which are provided at the respective ends of the series of nipples 38. These bumpers 36 and 37 are discussed further subsequently, and protect the nipples from engaging the spring biased deflection plates, also discussed subsequently.

Figure 4:
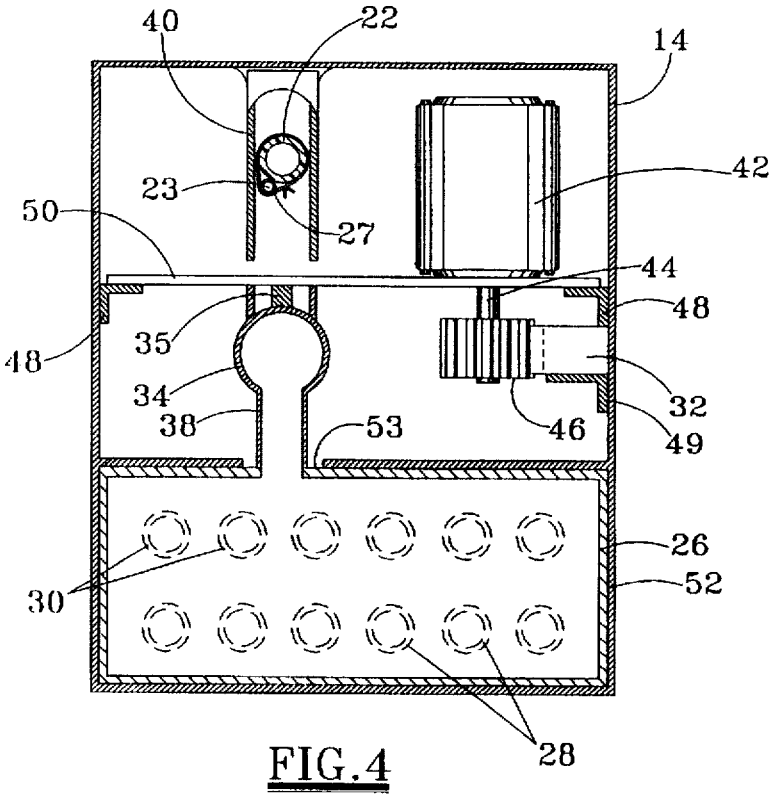
FIG. 4 is a cross-sectional view of the tube bundle cleaning assembly generally shown in FIG. 1.

FIG. 4 is a cross-sectional view of the lance housing 52 generally shown in FIG. 1, which both houses the lances 28 and 30, and guides the manifold 26 during its reciprocation. FIG. 1 also illustrates more clearly the rectangular configuration of the sheet metal housing or shell 14. A horizontal plate 50 is supported on elongate angled members 48 and extends between the sidewalls of shell 14 to support the motor 42 during the reciprocating movement of the lances. Motor 42 rotates shaft 44 and thus pinion gear 46, which meshes with rack gear 32, which is fixed to the side of the lance housing, to drive or reciprocate the manifolds and lances. The elongate gear 32 of the rack and pinion assembly may be bolted, welded, or otherwise secured to the shell 14 of the lance assembly, and FIG. 4 depicts an angled bracket 49 for supporting the elongate gear 32.

Receiving manifold 34 may be secured by a bracket 35 or other suitable member to the sliding plate 50. The nipples 38 fixedly interconnect the receiving manifold 34 with the box-like lance manifold 26. The lance manifold 26, in turn, slides within the similarly shaped lance housing 52 having a slightly larger cross-sectional configuration. If desired, the entirety of the lance housing 52 may be formed from extruded stainless steel tubing which is bent to the desired rectangular cross-sectional configuration. Each of the lances 28 and 30 and the lance manifold 26 are thus moved by hydraulic motor 42 in a direction parallel with lance axis 11 shown in FIG. 1.

The lance housing 52 may be formed as a part of the shell 14, or may be a housing separate from and secured within the shell 14. Those skilled in the art will appreciate that the elongate lances, whose position is represented by the dashed lines in FIG. 4, are relatively flexible, and that the lance housing 52 is highly desirable to prevent excessive flexing or bending of the lances as they move toward the tube bundle. Once a lance is positioned within its desired bundle tube, it is substantially confined and thus need not be restrained by the lance housing 52 to prevent undue flexing.

FIG. 4 also depicts the configuration of an elongate guide 40 for generally receiving therein the flexible fluid line 22 and the hydraulic line 23 during reciprocating movement of the lances. The guide 40 thus prevents undesirable lateral movement of the lines 22 and 23 within the upper portion of the housing during operation of the lance assembly 10, and thus desirably keeps lines 22 and 23 generally within a vertical plane for interconnection with the receiving manifold 34 with the hydraulic motor 42, respectively. The guide 40 may be attached by conventional bolts and/or welding to the frame 12 or the sheet metal housing or shell 14. As previously noted, a plurality of conventional tying members, such as straps 27, may be used along the length of the lines to keep the flexible lines 22 and 23 generally adjacent each other. Referring again to FIG. 1, the flexible lines 22, 23 thus bend in a generally semi-circular shape from the upper portion of the housing to the lower portion of the housing, and then continue toward the front end of the assembly 10 until they are positioned generally adjacent the receiving manifold 34.

Figure 3:
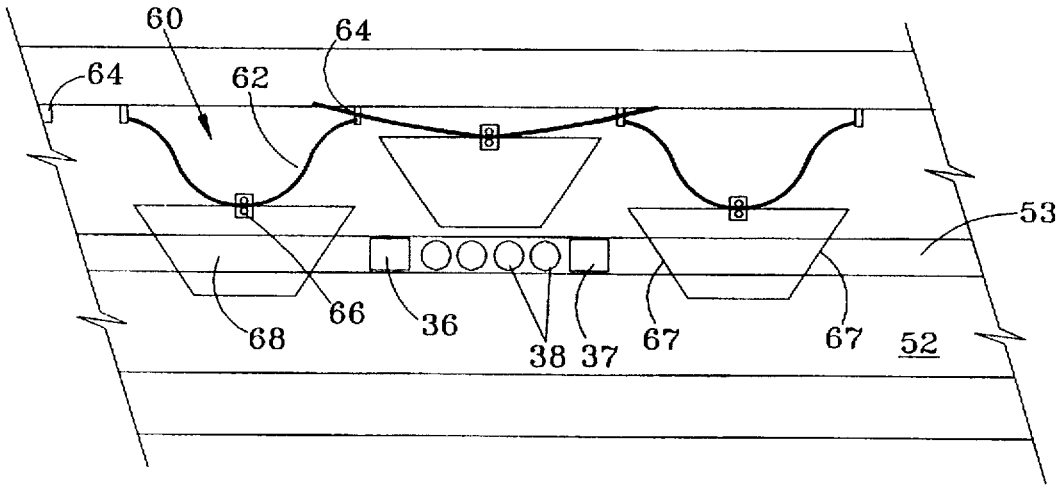
FIG. 3 is a top view of a slot in the manifold housing and a plurality of spring biased cover plates for normally covering the slot.

It is a particular feature of the present invention that a relatively low pressure drop occurs between the inlet 24 for the high pressure water and the discharge end of the lances 28 and 30. That desired goal is preferably accomplished by providing a single relatively large diameter hose 22 within the assembly 10 for interconnecting the inlet port 24 with the receiving manifold 34. According to the present invention, a hose having an internal diameter of approximately a 2.5 centimeters (1 inch) is used, rather than providing a plurality of smaller diameter hoses each extending to the lance manifold, since the larger hose is capable of handling the same flow rate with a comparatively lower pressure drop. The hose 22 extends from the inlet 24 all the way to the manifold 34, and has a single semi-circular bend therein which moves within the shell 14 during lance movement. It is also desirable to utilize a lance manifold 52 with a relatively narrow slot for receiving the high pressure water, and this goal is accomplished by providing both a receiving manifold and a lance manifold, in combination with a plurality of relatively small diameter and short nipples fluidly interconnecting these manifolds and arranged in a row as shown in FIG. 3, so that the axes 39 of these nipples lie within a substantially common vertical plane. The design as explained above is preferred rather than having the hose 22 flow directly to the lance manifold 26, since according to the present invention the width of the slot for receiving the plurality of nipples 38 may be reduced, while simultaneously avoiding drastic bends in the hose which would contribute to a larger pressure drop. According to the design of the present invention, the water pumping unit generating approximately 8,000 psi and having a flow rate of approximately 60 gpm may transmit pressure fluid to the lances, with a comparatively low pressure drop between the pumping unit and the tip end of the lances being less than approximately 20 psi, thereby substantially contributing to the desired high pressure for an effective cleaning operation.

The elongate guide 40 may have an inverted U-shaped cross-sectional configuration with a downwardly facing opening for receiving the movable C-shaped bend in the hose 22. The hose guide 40 is important, particularly when the lances are being withdrawn from the tube bundle, since during this time the C-shaped bend effectively moves toward the rear end of the assembly 10 in a uniform and predictable manner due to the guide 40 maintaining all or substantially all of the hose 22 within a single vertical plane between the inlet and the receiving manifold. Also, the receiving manifold 34 performs an important function during this lance withdrawal operation by effectively pushing uniformly on the discharge end of hose 22 in a direction substantially parallel with the movement of the manifold (and thus parallel to lance axis 11). Accordingly, the rear plate 89 on the receiving manifold which pushes against the hose 22 is preferably within a plane perpendicular to axis 11. Also, the entirety of hose 22 is maintained above the slot 53 in the lance manifold, and no sharp bends in hose 22 are likely to occur during operation of the assembly 8.

Referring now to FIG. 3, the elongate slot 53 in the lance housing 52 is more clearly depicted, with the position of the nipples 38 and the bumpers 36 and 37 as shown in FIG. 2 is illustrated relative to the lance housing 52. As suggested above, the elongate slot 53 in the lance housing desirably is covered to prevent one or more of the relatively flexible lances 30 from "jumping out" through the slot 53 during the lancing operation. It should be understood, however, that the nipples 38 need to pass along the length of the slot as the manifolds 34 and 26 reciprocate relative to the lance housing 52, which is fixed within the shell 14. According to the present invention, this is accomplished by providing a plurality of plate assemblies 60 each including a plate 68 spaced along and engaging the top of the lance housing 53. Each plate 68 thus covers a portion of the slot 53, and together the plates 68 prevent the lances from coming out through the slot 53. Each deflection plate 68 is biased for coveting the slot by a respective leaf spring 62, which may be secured to the lance housing by connectors 64. Each spring biased deflector plate assembly 60 also includes a hinge member 68 for interconnecting the leaf spring 62 with the deflector plate 68, so that the deflector plate 68 may remain in planer contact with the top planer surface of the lance housing 52. The width of slot 53 may be increased since the plate assemblies prevent the lances from inadvertently coming out of the lance housing. Nevertheless, a relatively thin slot 53 is still desired to minimize the likelihood of substantial forces repeatedly acting on the plate assemblies.

As the lances are reciprocated within the frame 12, one of the bumpers 36 and 37 engages the angled leading or trailing surface 67 of a plate 68, thereby exerting a force which overcomes the biasing force of the leaf spring 62 and moves the deflector plate toward the spring mount 64. Once the bumpers 36 and 37 and the nipples 38 spaced between these bumpers passed by one of the deflector plate assemblies, that deflector plate 68 will return to its normal position for covering the slot 53 due to the biasing force of the leaf spring 62.

Referring again to FIG. 1, it should be understood that the connector 18 is positioned along the mass centerline 17 of the powered lance assembly 10 when the lance tubes 28 and 30 are in their fully retracted position. Accordingly, a hook (not shown) at the end of flexible line extending downward from an overhead crane may engage the connector 18, and the assembly 10 as shown in FIG. 1 may be elevated while remaining substantially horizontal, as shown in FIG. 1. This pivot balance design for the hitch or the connector 18 allows the operators to more easily manipulate the assembly 10 to a proper position relative to a tube bundle for a horizontal cleaning operation. Both inlets 24 and 25, and particularly inlet 25 for the water hose 94, are substantially aligned with the centerline 17, so that the weight of the flexible hoses 94 and 95 (which depend on the elevated height of the lance assembly and the position of units 90 and 91) does not alter the designed uniform balancing of the assembly 10 about connector 18. It should also be understood that once the assembly 10 is activated so that the lances begin to pass through the tubes of the bundle, the mass center of the assembly 10 will move somewhat toward the front end of the unit, and the assembly will tend to become "front end heavy" within the bundle. This is not a significant problem, however, since the assembly 10 will already have been properly positioned, and since the tube bundle itself will then act upon the ends of the lances. As previously noted, alignment pipes 13 may be utilized for positioning within respective receptacles (not shown) in the lance housing to serve as leverage or manipulating handles for assisting the operators in aligning the assembly 10 with respect to the tube bundle. Alternatively, the alignment pipes may be eliminated, and the operators may use guide tubes for the pattern plate (which extend outward from the front end of the lance assembly) as manipulating arms to desirably position the lance assembly.

According to the design of the present invention, each of the multilances exit the lower portion of the assembly 10, so that the tube bundle may be placed on a slab or on relatively low blocks, and the assembly 10 then conveniently positioned for cleaning the tube bundle. This is a significant advantage compared to prior art lance assemblies which utilize lances exiting the top of the lance assembly, since these prior art units require that the tube bundle be raised substantially so that the lances can be properly positioned for cleaning the tube bundle.

In another application, the entirety of the assembly 10 may be raised by a crane having a hook connected to connection plate 18 for cleaning an elevated tube bundle having substantially horizontal tubes. As indicated above, the pivot balance design for the assembly 10 enables files the entirety of the assembly to remain substantially horizontal while being elevated, since the mass centerline 17 passes through the connector 18 when the lances are fully withdrawn within the shell 14 of the assembly. This allows the cleaning crew to more easily position the assembly 10 with respect to the tube bundle in order to initiate the lancing operation. The operator control box 92 may be positioned at any desired location, such as the floor or on a catwalk adjacent and slightly above the tube bundle, and includes on/off switch 94A and forward/reverse switch 94B each for controlling the desired operation of drive motor 42. Hydraulic electrical control lines 99 may interconnect the control box 92 with the necessary valves and/or switches to control operation of the assembly 8, although the control box 92 could easily include remote control technology so that line 99 was not required. The flexible lines 94, 95 extend from the skid mounted units 90, 91 on the floor to the assembly 8. The cleaning crew may thus easily and reliably control the operation of the lancing assembly without having to erect scaffolding or other supporting structure. By independently controlling the operation of valves 97, 98, both the fluid flow rate and the pressure to the drive motor 42 may be regulated, so that the operator can achieve the desired speed for movement of the lances within the tube bundle and also achieve the desired force and mechanical pressure exerted on the lances while moving within the tube bundle, thereby contributing to an efficient cleaning operation while reducing the likelihood of damage to the lances and/or the tube bundle.

It should be understood that various modifications are contemplated by and within the scope of the present invention. The invention accordingly is not limited to the particular apparatus and methods discussed herein, since the foregoing disclosure and description of the invention are illustrative and explanatory. Various changes in the structure as well as the methods may thus be made without departing from the present invention.

What is claimed is:

1. A method of cleaning a tube bundle having a plurality of elongate flow tubes, the method comprising:

(a) providing an elongate lance housing within a lower portion of a cleaning assembly outer shell for substantially restricting movement of a plurality of elongate tubular lances;

(b) moving the plurality of elongate tubular lances within the lance housing while discharging pressurized fluid to clean the tube bundle during a operation;

(c) simultaneously moving a receiving manifold within the cleaning assembly outer shell and exterior of the lance housing while receiving high pressure fluid from a flexible hose within the cleaning assembly;

(d) simultaneously moving a lance manifold within the lance housing outer shell while providing fluid communication between a lance manifold chamber and each of the plurality of elongate tubular lances; and (e) positioning a plurality of nipple members for fluidly interconnecting the receiving manifold and the lance manifold.

2. The method as defined in claim 1, further comprising:

providing a hydraulic fluid line for powering movement of the plurality of elongate tubular lances, the receiving manifold, the lance manifold, and the plurality of nipples;

controlling a flow rate of hydraulic fluid through the hydraulic fluid line; and independently controlling a pressure of hydraulic fluid through the hydraulic fluid line.

3. The method as defined in claim 1, further comprising:

positioning a plurality of spring biased plates each for covering a slot in the lance housing and being movable for uncovering the slot to permit reciprocation of the receiving manifold, the lance manifold, and the plurality of lances.

4. The method as defined in claim 3, further comprising:

arranging a nipple centerline of each of the plurality of nipples within a single plane.

5. A method of cleaning a tube bundle having a plurality of elongate flow tubes, the method comprising:

(a) inputting high pressure fluid for cleaning the tube bundle moveable within an outer shell having one or more input ports;

(b) providing a flexible fluid hose for interconnecting the one or more input ports and a plurality of elongated tubular lances;

(c) guiding at least portions of the fluid hose within a substantially vertical plane while maintaining a single bend in the fluid hose;

(d) providing a lance housing for restricting movement of the plurality of elongate tubular lances, the lance housing having an elongate slot therein;

(e) providing a receiving manifold having a receiving chamber therein exterior of the lance housing for receiving high pressure fluid from the flexible fluid hose;

(f) providing a lance manifold having a lance manifold chamber therein within the lance housing and in fluid communication with each of the plurality of elongate tubular lances;

(g) positioning the plurality of nipple members for fluidly interconnecting the receiving manifold and the lance manifold; and (h) moving a plurality of elongate tubular lances within the outer shell while maintaining fluid communication between the plurality of tubular lances and the lance manifold during a cleaning operation.

6. The method as defined in claim 5, further comprising:

positioning a plurality of spring biased plates each for normally covering a slot in a lance housing and being movable for uncovering the slot to permit reciprocation of the receiving manifold, the lance manifold, and the plurality of lances.

7. The method as defined in claim 5, further comprising:

providing a hydraulic fluid line for powering movement of the plurality of elongate tubular lances, the receiving manifold, the lance manifold, the plurality of nipples;

controlling a flow rate of hydraulic fluid through the hydraulic fluid line; and independently controlling a pressure of hydraulic fluid through the hydraulic fluid line.

8. The method as defined in claim 5, further comprising:

providing a powered drive mechanism for reciprocating the plurality of lances during the cleaning operation;

controlling a flow of hydraulic fluid to the powered drive mechanism; and controlling a pressure of hydraulic fluid to the powered drive mechanism.

9. The method as defined in claim 5, further comprising:

supporting a high pressure water source separate from the outer shell; and interconnecting the high pressure water source with the one or more input ports with a flexible water line.

10. The method as defined in claim 5, further comprising:

providing a rack and pinion assembly for reciprocating the plurality of lances.

11. The method of cleaning a tube bundle having a plurality of elongate flow tubes, the method comprising:

(a) providing a lance housing within a cleaning assembly outer shell for substantially restricting movement of a plurality of elongate tubular lances, the lance housing having an elongate slot therein;

(b) moving the plurality of elongate tubular lances within the lance housing while discharging pressurized fluid from the plurality of lances to clean the tube bundle during a cleaning operation;

(c) simultaneously moving a lance manifold within the lance housing while providing fluid communication between a lance manifold chamber and each of the plurality of elongate tubular lances; and (d) biasing a plurality of plates for covering the slot, each of the plurality of plates being movable for uncovering the slot to permit reciprocation of the lance manifold and the plurality of tubular lances.

12. The method as defined in claim 11, further comprising:

providing a powered drive mechanism for reciprocating the plurality of lances during the cleaning operation;

controlling a flow of hydraulic fluid to the powered drive mechanism; and controlling a pressure of hydraulic fluid to the powered drive mechanism.

13. The method as defined in claim 11, further comprising:

supporting a high pressure water source separate from the outer shell; and interconnecting the high pressure water source with the one or more input ports with a flexible water line.

14. The method as defined in claim 11, further comprising:

simultaneously moving a receiving manifold within the cleaning assembly outer shell and exterior of the lance housing while receiving the pressurized fluid from a flexible hose within the cleaning assembly outer shell; and positioning a plurality of nipple members for fluidly connecting the receiving manifold and the lance manifold.

15. The method as defined in claim 14, further comprising:

providing a hydraulic fluid line for powering movement of the plurality of elongate tubular lances, the receiving manifold, the lance manifold, and the plurality of nipple members;

controlling a flow rate of hydraulic fluid through the hydraulic fluid line; and independently controlling a pressure of hydraulic fluid through the hydraulic fluid line.

16. The method as defined in claim 14, further comprising:

arranging a nipple centerline of each of the plurality of nipple members within a single plane.

* * * * *

UNITED STATES PATENT AND TRADEMARK OFFICE

CERTIFICATE OF CORRECTION

PATENT NO. : 5,735,964

DATED : April 7, 1998

INVENTOR(S) : Jim A. Amuny

It is certified that error appears in the above-indentified patent and that said Letters Patent is hereby corrected as shown below:

In Column 11, line 23, after "movable" insert traversely with respect to the elongate slot--.

In Column 11, line 63, after "normally" insert --traversely with respect to the elongate slot--.

In Column 12, line 40, after "movable" insert --traversely with respect to the elongate slot--.

Signed and Sealed this

Tenth Day of November 1998

*Attest:*

BRUCE LEHMAN

*Attesting Officer*

*Commissioner of Patents and Trademarks*